US011330943B2

(12) United States Patent
Hill

(10) Patent No.: US 11,330,943 B2
(45) Date of Patent: May 17, 2022

(54) TOILET AID FOR INDIVIDUALS WITH VISUAL AND PERCEPTION CHALLENGES

(71) Applicant: Nancy Hill, Brooklandville, MD (US)

(72) Inventor: Nancy Hill, Brooklandville, MD (US)

( * ) Notice: Subject to any disclaimer, the term of this patent is extended or adjusted under 35 U.S.C. 154(b) by 0 days.

(21) Appl. No.: 16/338,910

(22) PCT Filed: Oct. 3, 2017

(86) PCT No.: PCT/US2017/054839
§ 371 (c)(1),
(2) Date: Apr. 2, 2019

(87) PCT Pub. No.: WO2018/067498
PCT Pub. Date: Apr. 12, 2018

(65) Prior Publication Data

US 2020/0008634 A1 Jan. 9, 2020

Related U.S. Application Data

(60) Provisional application No. 62/403,814, filed on Oct. 4, 2016.

(51) Int. Cl.
*A47K 13/18* (2006.01)

(52) U.S. Cl.
CPC ..... *A47K 13/18* (2013.01)

(58) Field of Classification Search
CPC ..... A47K 13/18
USPC ..... 4/245.7
See application file for complete search history.

(56) References Cited

U.S. PATENT DOCUMENTS

| | | | |
|---|---|---|---|
| 2,247,337 | A | 6/1941 | Harry |
| 2,676,332 | A | 4/1954 | Inman |
| 3,982,288 | A | 9/1976 | Borne |
| 4,747,167 | A | 5/1988 | Adams |
| 5,136,731 | A | 8/1992 | Caro et al. |
| 5,625,905 | A | 5/1997 | Woods |
| 5,815,851 | A | 10/1998 | Perry |
| 6,032,302 | A | 3/2000 | Eckert |
| 6,119,282 | A | 9/2000 | Serbin |
| 6,874,171 | B2 | 4/2005 | Erves |
| 7,412,732 | B1 | 8/2008 | Leonard |
| 8,091,152 | B1 | 1/2012 | Rucker et al. |
| 8,856,976 | B1 | 10/2014 | Niedzielski, III |
| 9,232,766 | B1 | 1/2016 | Strohdach, Sr. et al. |
| 2006/0260030 | A1 | 11/2006 | Murray et al. |
| 2009/0211007 | A1 | 8/2009 | Partridge |
| 2011/0253063 | A1 | 10/2011 | Lapidge et al. |
| 2013/0084550 | A1 | 4/2013 | Mackie |
| 2015/0000023 | A1 | 1/2015 | Massey |
| 2015/0000024 | A1 | 1/2015 | Plath |
| 2015/0211221 | A1 | 7/2015 | Tarabay |
| 2015/0297044 | A1 | 10/2015 | McCarthy et al. |

OTHER PUBLICATIONS

International Search Report and Written Opinion for PCT/US2017/054839 dated Dec. 15, 2017.

*Primary Examiner* — Christine J Skubinna
(74) *Attorney, Agent, or Firm* — Law Offices of Kathleen Lynch, PLLC; Kathleen M. Lynch

(57) ABSTRACT

An insert for use as a visuoperceptual aid while using the toilet. The insert has an upper surface. The upper surface is sized and shaped to fit onto the rim or seat of a standard toilet basin. The insert further includes inner and outer surfaces for slidingly engagement with the inner and outer surfaces of a toilet basin respectively. The insert is yellow-green in color.

16 Claims, 3 Drawing Sheets

TOILET AID FOR INDIVIDUALS WITH VISUAL AND PERCEPTION CHALLENGES

CROSS REFERENCE TO RELATED APPLICATIONS

This application is a 35 USC 371 application of International PCT Patent Application No. PCT/US2017/054839, filed on Oct. 3, 2017, which claims priority to U.S. Provisional Patent Application No. 62/403,814, filed on Oct. 4, 2016; the contents of which are hereby incorporated by reference herein in their entireties.

FIELD

A system and method of providing a toilet aid to individuals who have visuoperceptual challenges. The visual aid is a yellow-green colored attachment that fits on the toilet bowl rim or seat providing an outline of the toilet bowl, thus making it is easier to see and perceive when using the toilet.

BACKGROUND

When the brain is cognitively compromised by disease or time as a result of dementia, Alzheimer's, age and the like, the transmission of visual information to the brain can be interrupted resulting in reduced or distorted vision. The difficulties that some individuals experience are directly related to the type of dementia they have. For example, Posterior Cortical Atrophy starts in the parietal and occipital lobes, thus compromising depth of perception and visual input. Other dementias affecting vision include Alzheimer's, Parkinson's disease dementia, dementia with Lewy Bodies, and vascular dementia. Changes to the visual field, problems directing or changing a gaze, reduced ability to detect colors, and depth perception are examples of visuoperceptual challenges individuals face. Visuoperceptual problems can greatly reduce the quality of life for people with dementia and those with limited vision. Visually impaired or limited vision occurs because of refractive errors, cataracts, glaucoma, age-related macular degeneration, corneal clouding, diabetic retinopathy, as well as neurological conditions due to stroke and trauma. Reduced vision because of dementia or physiological reasons causes complications with toileting.

As the brain loses its ability to process visual data, depth perception becomes difficult for visuoperceptual-challenged individuals. Without contrasting color tones, the toilet appears flat. As a consequence, urinating in a toilet is compromised, especially for me. If a toilet cannot be seen, it is hard to maintain continence. In addition, individuals with visuoperceptual challenges lose their ability to visually process color. Research has shown that the eye is most sensitive to the yellow-green color. The use of the yellow-green color has been effective in assisting Alzheimer's and visually-challenged individuals maintain autonomy. The yellow-green color is represented by pantone colors: 802-C, 2287-C, 2421-C, and 2271-C.

Many visuoperceptual-challenged individuals desire to live as independently as possible within their limitations. Thus, it is important to enable any such patient to function with as little intervention as possible while improving their quality of life. As such, it is helpful to provide these individuals with a visual aid in using the toilet as their depth perception and their ability to detect colors diminish. In many instances, the color of the toilet bowl and the color of the bowl are the same. For someone with extremely limited chromatic vision, the toilet bowl appears flat against the floor. There is a need to provide a visual aid for use by individuals who are visuoperceptual-challenged to use the toilet independently and effectively.

DETAILED DESCRIPTION

Figure 1:
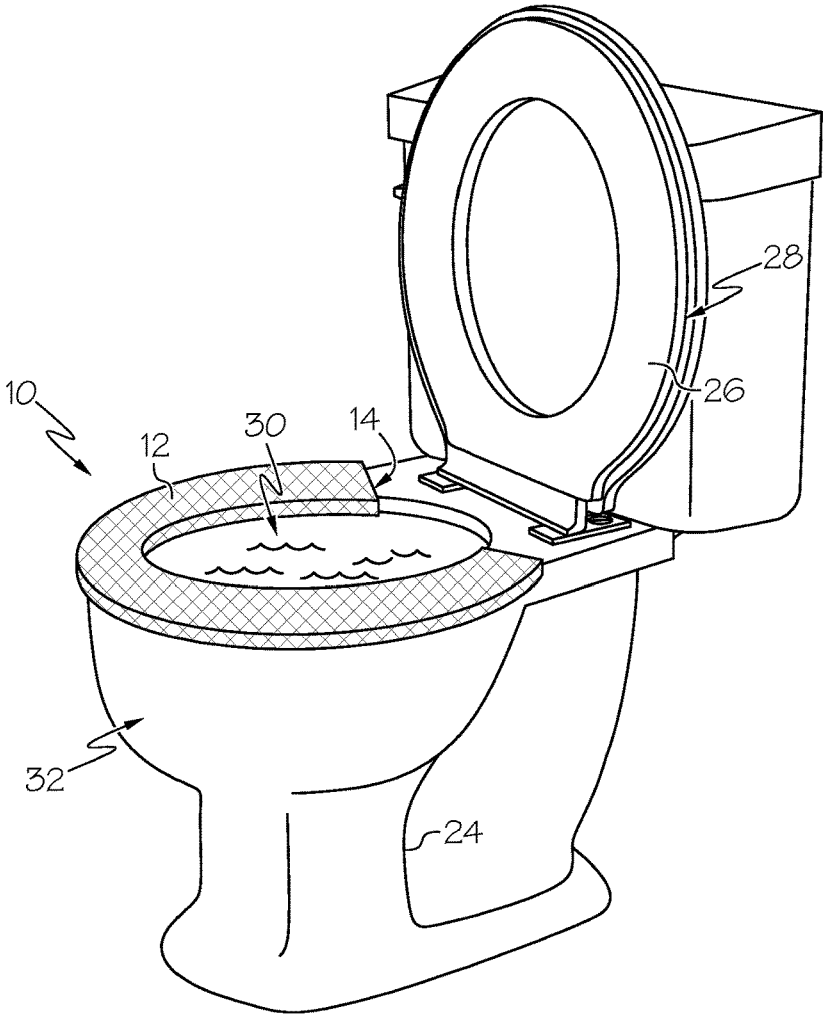
FIG. 1 is a perspective view of the first embodiment described herein.
Figure 2:
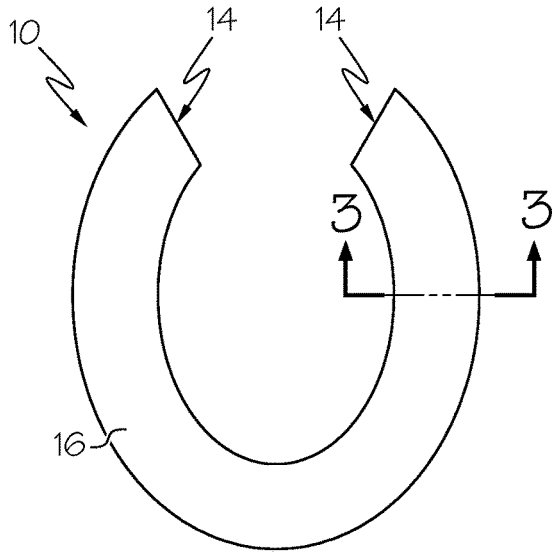
FIG. 2 is a top view of the embodiment of FIG. 1.
Figure 3:
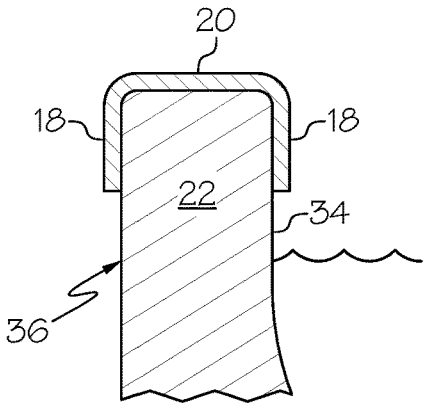
FIG. 3 is a sectional view of the embodiment of FIG. 2 taken along lines 3-3.

The embodiments described herein are directed to a removable sleeve designed to fit over the rim of the toilet porcelain base. The first embodiment 10 is shown in FIG. 1. The first embodiment 10 includes a u-shaped channel 12, The channel has ends 14 and a length 16. The channel 12 has a cross-section shown in FIG. 3. The cross-section of the channel 12 has sides 18 and a top surface 20. The dimensions of the cross-section are sized to fit over the porcelain rim 22 of a standard toilet 24. The toilet has a standard seat 26 and lid 28 hingedly attached to the rim 22. The toilet rim 22 is adjacent to the opening 30 in the toilet 24. The toilet rim 22 is the top of the toilet basin 32 having inner 34 and outer 36 basin walls.

The first embodiment 10 is preferably made of a medical grade polymer for easy cleaning and minimal capacity to retain bacteria and the like. Moreover a medical grade polymer will retain its shape and not easily degrade when exposed to the rigors of sanitization and urine. The first embodiment 10 is preferably yellow-green in color. This can be accomplished with colored polymer or coating the embodiment with a dye or paint of that color. The yellow-green color targets the middle wavelengths of the spectrum, thus maximizing and enhancing the visual perception of the Alzheimer's or visually impaired patient. Preferably the yellow-green color is identified by one or more of the following Pantone colors: 802-C, 2287-C, 2421-C and 2271-C.

In use, the user first lifts the seat 26 and lid 28 upwardly to fully expose the toilet rim 22 and basin 32. Then the user positions the first embodiment 10 over the opening 30 of the toilet 24. The ends 14 are positioned adjacent to the hinge for the seat 26 and lid 28. The length 16 of the u-shaped channel 12 is positioned above the rim 22. In addition, the first embodiment 10 is positioned so that the sides 18 are pointed downwardly towards the rim 22 of the toilet 24.

To attach the first embodiment 10 to the toilet 24, the user pushes the first embodiment 10 downwardly so that the sides 18 receive the toilet rim 22. The sides 18 slidingly engage the inner 34 and outer 36 walls of the toilet basin 32. As the user pushes the first embodiment 10 downwardly, the sides 18 receive the toilet rim 22 and travel stops when the top surface 20 rests against the rim 22. In this position, the sides 18 are in frictional engagement with the inner 34 and outer 36 walls of the basin 32. The first embodiment 10, when fully installed, appears as a horse-shoe shaped insert over the toilet rim 22.

Once the first embodiment 10 is installed, the patient can see the first embodiment 10 as it rests over the rim 22. This provides a visual aid to the patient and enables him to urinate into the toilet basin 32 with greater accuracy. After the patient has used the first embodiment 10 it may be removed for cleaning. The first embodiment 10 is removed by pulling upwardly on the length 16. This causes the sides 18 to move upwardly relative to the rim 22. As the sides 18 move upwardly they disengage from contact with the inner 34 and outer 36 basin walls.

Once the first embodiment 10 is completely removed from the toilet 24, it can be wiped or cleaned as needed. To reuse, the first embodiment is inserted onto the toilet rim 22 as described above.

Figure 6:
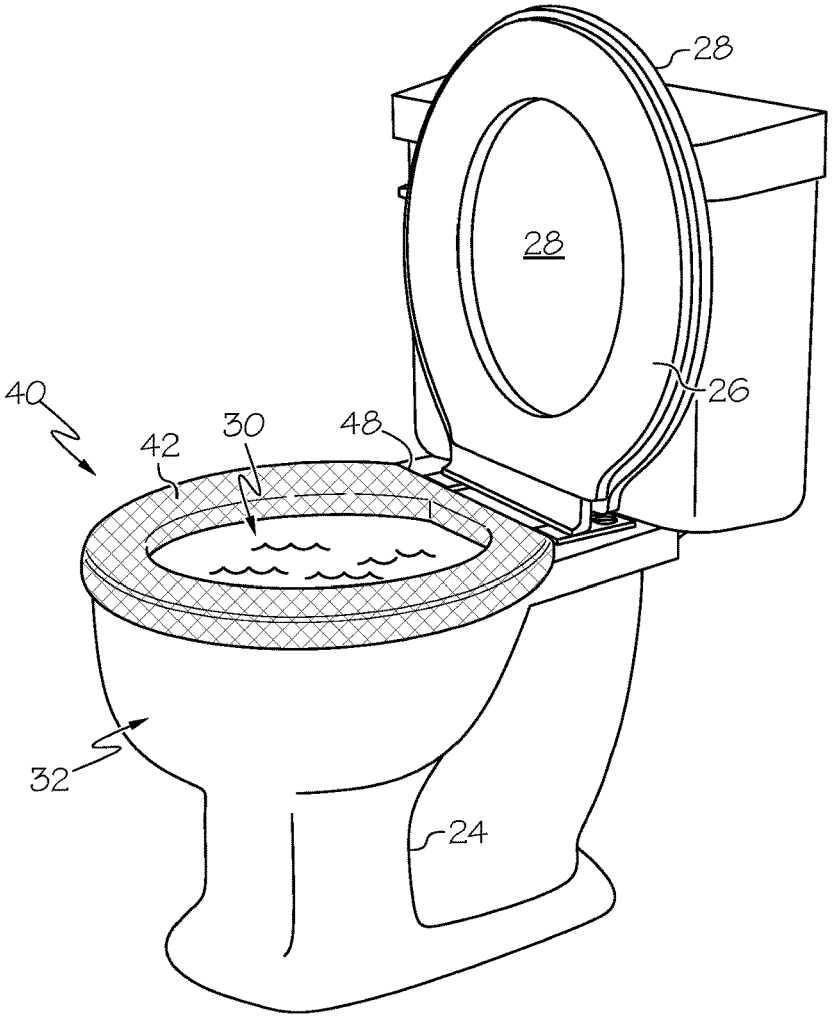
FIG. 6 is a perspective view of the second embodiment described herein.
Figure 4:
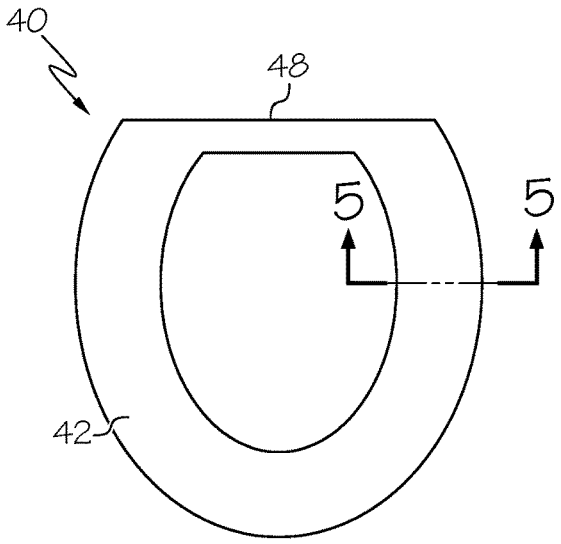
FIG. 4 is a top view of a second embodiment described herein.
Figure 5:
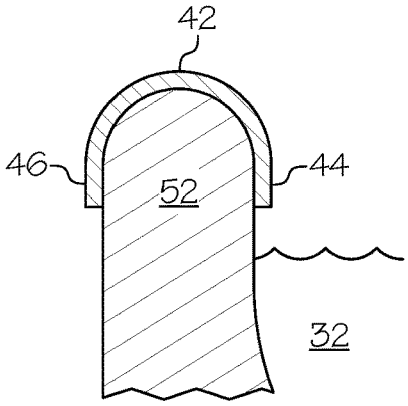
FIG. 5 is a sectional view of the embodiment of FIG. 4.
Figure 7:
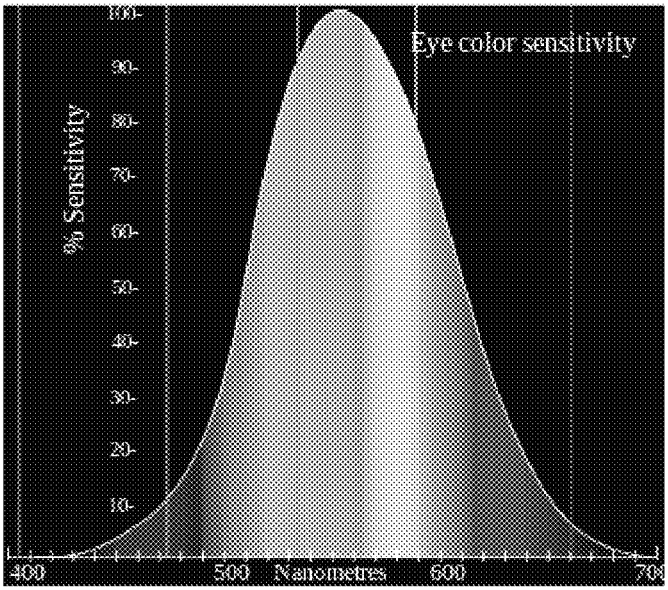
FIG. 7 is an illustration of how the eye responds to light.

A second embodiment 40 is disclosed in FIGS. 4-6, As shown in FIG. 5, the second embodiment 40 includes a top surface 42, inner side surface 44 and outer side surface 46. The second embodiment 40 is shaped to fit over a toilet bowl 50 having a rounded rim 52. Turning to FIG. 4, the top surface 42 is oval-shaped and sized to fit onto the opening of the toilet bowl 50. A flat section 48 is located along a portion of the top surface 42. The flat section 48 is designed to fit adjacent to the hinges for the toilet seat 26 and lid 28 when installed, as shown in FIG. 6.

To install the second embodiment 40, the toilet seat 26 and lid 28 are moved upwardly so that the toilet bowl opening 50 is accessible. The second embodiment 40 is placed over the toilet bowl opening 50. The shape of the second embodiment 40 is aligned with the shape of the toilet bowl opening 50. In particular, the flat section 48 is placed adjacent to the hinges for the toilet seat 26 and lid 28. Once the second embodiment 40 is aligned with the toilet bowl opening, the user pushed down on the top surface 42 causing the inner 44 and outer 46 walls to slide along the inner and outer rims of the toilet bowl respectively. This is done until the top surface 42 is in contact with the rounded rim 52. Once installed, the patient uses the second embodiment 40 in the same manner as the first embodiment 10.

It should be appreciated that some toilets may have variations in the shape of the bowl and rim. In such cases, the shape of the body of the embodiment will be shaped to accommodate the shape of the toilet bowl and the cross-section of the embodiment will be shaped to accommodate the shape of the rim. This should include but not be limited to oval, squared, rectangular and the like. Moreover, while the embodiments have referred to porcelain toilet bowls, it is appreciated that the embodiments herein described may equally be used on stainless steel, plastic or other toilet bowls. In addition, it should be appreciated that the embodiments described herein would apply equally to toilets or commodes in campers, on boats, portable and bedside toilets and the like.

While the embodiments described herein are preferred embodiments, it will be understood that it is not intended to limit the embodiments as disclosed. On the contrary, it is intended to cover all alternatives, modifications and equivalents as may be included in the spirit and scope as described herein and defined by the appended claims. Terms such as "inner" and "outer" are for reference purposes only and are not intended to be limiting in any way.

The invention claimed is:

1. A visuoperceptual implement for a toilet bowl to aid a user in urinating into the toilet bowl while standing, the toilet bowl having a basin, the basin having inner and outer walls, and a toilet rim, the toilet bowl further having a color, the implement comprising:

a uniform sleeve having a u-shaped cross section, the cross section having a top surface and two parallel spaced apart sides, the sleeve sides sized to slidingly engage the inner and outer basin walls over at least a majority of the length of the inner and outer walls, wherein the sleeve is a contrasting color to the toilet basin.

2. The implement of claim 1 wherein the sleeve is made of a medical grade polymer.

3. The implement of claim 1 wherein the color is identified by one or more of the following Pantone colors: 802-C, 2287-C, 2421-C and 2271-C.

4. The implement of claim 1 wherein implement is removable.

5. A sleeve used as a visuoperceptual aid while using a toilet, having a toilet bowl, the toilet bowl having, a rim, a basin, and inner and outer basin walls, the inner basin wall defining an inner basin perimeter, the toilet bowl having a first color, the sleeve comprising:

an elongated body having a length and first and second ends, the elongated body having a contrasting color to the toilet bowl color;

a cross section having a pair of spaced apart walls extending from a middle section, whereby the spaced apart walls slidingly fit over the rim of a toilet bowl and engage the inner and outer walls of the basin, providing an outline of the toilet bowl.

6. The sleeve of claim 5 wherein the sleeve is a medical grade polymer.

7. The sleeve of claim 5 wherein the sleeve is a coated stainless steel.

8. The sleeve of claim 5 wherein the color is identified by one or more of the following Pantone colors: 802-C, 2287-C, 2421-C and 2271-C.

9. The sleeve of claim 5 further comprising at least one tab extending from the length to aid in the removal of the sleeve from the toilet bowl.

10. An insert for use as a visuoperceptual aid while using the toilet, the insert comprising:

an upper surface sized and shaped to engagingly fit onto the rim of a toilet basin, the toilet basin having inner and outer surfaces, the inner surface defining a basin inner perimeter, and having a color;

an inner insert surface for slidingly engagement with a substantial portion of the inner surface of the toilet basin providing an outline of the inner surface of the toilet basin;

an outer insert surface for sliding engagement with a substantial portion of the outer surface of the toilet basin, whereby the insert is a contrasting color to the toilet basin color.

11. The insert of claim 10 wherein the insert color is identified by one or more of the following Pantone colors: 802-C, 2287-C, 2421-C and 2271-C.

12. The insert of claim 10 wherein the insert s made of a medical grade polymer.

13. The insert of claim 10 wherein the insert is a coated stainless steel.

14. The insert of claim 10 further comprising a tab extending outwardly from the outer surface wherein the tab is used to remove the insert after use.

15. The insert of claim 10 wherein a portion of the upper surface further comprises a flat section.

16. The insert of claim 15 wherein during use the flat section is adjacent to the toilet seat and lid.

* * * * *